US006935243B2

(12) United States Patent
Dippold

(10) Patent No.: US 6,935,243 B2
(45) Date of Patent: Aug. 30, 2005

(54) BULLET

(75) Inventor: Jack D. Dippold, Edwardsville, IL (US)

(73) Assignee: Olin Corporation, East Alton, IL (US)

( * ) Notice: Subject to any disclaimer, the term of this patent is extended or adjusted under 35 U.S.C. 154(b) by 0 days.

(21) Appl. No.: 10/377,903

(22) Filed: Mar. 3, 2003

(65) Prior Publication Data

US 2003/0213396 A1 Nov. 20, 2003

Related U.S. Application Data

(60) Provisional application No. 60/361,658, filed on Mar. 4, 2002.

(51) Int. Cl.[7] ..... F42B 30/02; F42B 12/34

(52) U.S. Cl. ..... 102/509; 102/508; 102/514

(58) Field of Search ..... 102/507–510, 102/514–517

(56) References Cited

U.S. PATENT DOCUMENTS

| | | | | | |
|---|---|---|---|---|---|
| 1,072,880 | A | * | 9/1913 | Tewes | 102/514 |
| 1,095,501 | A | * | 5/1914 | Hoagland | 102/509 |
| 1,135,357 | A | * | 4/1915 | Clyne | 102/508 |
| 1,633,168 | A | | 6/1927 | Dickerman | |
| 1,732,211 | A | * | 10/1929 | Olin et al. | 102/514 |
| 1,892,759 | A | | 1/1933 | Woodford | |
| 1,992,244 | A | * | 2/1935 | Schuricht | 205/93 |
| 3,349,711 | A | * | 10/1967 | Darigo et al. | 102/509 |
| 3,431,612 | A | | 3/1969 | Darigo et al. | 29/1.23 |
| 4,044,685 | A | * | 8/1977 | Avcin | 102/508 |
| 4,387,492 | A | * | 6/1983 | Inman | 86/55 |
| 4,610,061 | A | * | 9/1986 | Halverson | 86/55 |
| 4,655,140 | A | * | 4/1987 | Schirneker | 102/508 |
| 5,079,814 | A | * | 1/1992 | Moore et al. | 86/55 |
| 5,101,732 | A | | 4/1992 | Schluckebier | 102/509 |
| 5,131,123 | A | * | 7/1992 | Brooks | 86/54 |
| 5,259,320 | A | * | 11/1993 | Brooks | 102/509 |
| 5,357,866 | A | * | 10/1994 | Schluckebier et al. | 102/509 |
| 5,544,398 | A | * | 8/1996 | Corzine et al. | 86/55 |
| 6,244,187 | B1 | * | 6/2001 | Head | 102/516 |
| 6,257,149 | B1 | * | 7/2001 | Cesaroni | 102/515 |
| 6,352,600 | B1 | * | 3/2002 | Alexander | 148/536 |
| 6,694,888 | B2 | * | 2/2004 | Jopson et al. | 102/506 |
| 6,805,057 | B2 | * | 10/2004 | Carr et al. | 102/509 |

FOREIGN PATENT DOCUMENTS

| | | |
|---|---|---|
| DE | 4227068 | 2/1994 |

* cited by examiner

*Primary Examiner*—Michael J. Carone
*Assistant Examiner*—James S. Bergin
(74) *Attorney, Agent, or Firm*—Wiggin and Dana, LLP; Gregory S. Rosenblatt; Elizabeth A. Galletta

(57) ABSTRACT

A plated hollow-point bullet has a metallic plating which completely encapsulates a metallic core. A core precursor is formed having a nose compartment with an inwardly extending cavity. A metallic coating is applied to the precursor to completely encapsulate the precursor. The coated precursor is mechanically deformed by grooves formed along a surface of the cavity without breaching the coating.

10 Claims, 1 Drawing Sheet

BULLET

CROSS-REFERENCE TO RELATED APPLICATIONS

This patent application claims priority to U.S. Provisional Patent Application Ser. No. 60/361,658, entitled "BULLET" that was filed on Mar. 4, 2002, the disclosure of which is incorporated by reference in its entirety herein as if set forth at length.

BACKGROUND OF THE INVENTION (1) Field of the Invention

This invention relates to small arms ammunition, and more particularly to plated hollow point bullets particularly useful in common calibers of centerfire pistol and revolver (collectively "pistol") ammunition.

(2) Description of the Related Art

Historically, bullets have been of all lead or of jacketed lead constructions. A variety of cartridge sizes exist which may be used in pistols, rifles or both. Among key common pistol ammunition rounds are: .380 Automatic (also commonly designated 9 mm Kurz), 9 mm Luger (also commonly designated 9×19 and 9 mm Parabellum), .40 Smith & Wesson (S&W), .45 Automatic (also commonly designated Automatic Colt Pistol (ACP)) and 10 mm Automatic rounds. General dimensions of and pistol rounds are disclosed in Voluntary Industry Performance Standards for Pressure and Velocity of Centerfire Pistol and Revolver Ammunition for the Use of Commercial Manufacturers ANSI/SAAMI Z299.3-1993 (American National Standards Institute, New York, N.Y.), the disclosure of which is incorporated by reference herein as if set forth at length. A newer round, the 0.357 Sig is also gaining acceptance.

After many decades of use of the .45 ACP round, in the 1980's the U.S. Army adopted a 9 mm Luger full ogival, pointed, full metal case or jacket (FMC or FMJ) round as the standard round for use in military sidearms (also commonly designated as M882 9 MM Luger rounds). The parameters for the M882 9 mm Luger rounds purchased by the U.S. military are shown in U.S. Military standard MIL-C-70508, the disclosure of which is incorporated by reference in its entirety herein as if set forth at length. The jacket of an FMJ round is commonly formed as a rearwardly open brass cup into which a lead core is inserted. The combination cup and core is then deformed to form the bullet ogive with the jacket rim crimped partially around the bullet base, leaving a centrally exposed portion thereof.

Similar cups may be used to manufacture JHP bullets. In some such bullets, the cup is initially rearwardly open (e.g., as in commonly owned U.S. Pat. No. 5,544,398) whereas in others the cup is forwardly open to fully encapsulate the heel of the core.

The jackets may also be electroplated. U.S. Pat. No. 5,079,814 shows a bullet wherein a lead core precursor is fully electroplated with copper to initially totally encapsulate the precursor. The combination is then deformed to create a nose compartment or cavity. The deformation involves slitting the jacket along walls of the cavity to provide weakened areas to separate petals upon impact. This process leaves exposed lead within the cavity. In other JHP manufacturing processes, a nose portion of the bullet may be masked preventing plating thereon or the plating may be removed prior to finish forming. In either of these cases, the cavity interior and perhaps a portion of the exterior of the nose will have exposed lead.

BRIEF SUMMARY OF THE INVENTION

In one aspect, I have provided a plated hollow point bullet wherein metallic plating completely encapsulates a metallic core.

In other aspects, I have invented methods of manufacturing such fully encapsulated bullets. A core precursor is formed having a nose compartment. A metallic coating is applied to the precursor to completely encapsulate the precursor. The coated precursor is mechanically deformed without breaching the metallic coating.

The details of one or more embodiments of the invention are set forth in the accompanying drawings and the description below. Other features, objects, and advantages of the invention will be apparent from the description and drawings, and from the claims.

BRIEF DESCRIPTION OF THE DRAWINGS

Like reference numbers and designations in the various drawings indicate like elements.

DETAILED DESCRIPTION

Figure 1:
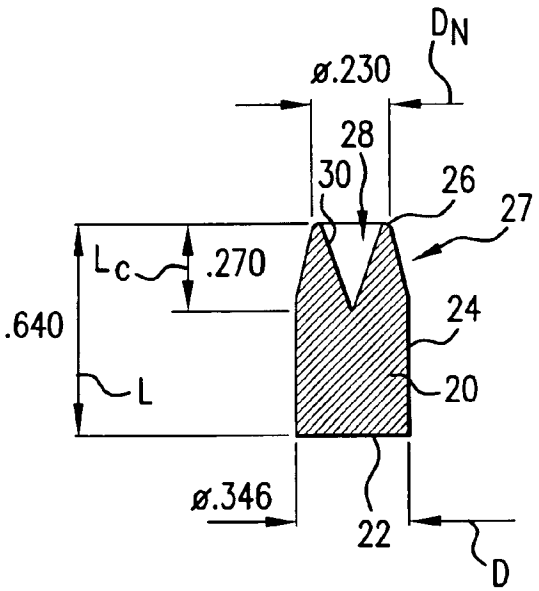
FIG. 1 is a longitudinal sectional view of an exemplary core precursor.

FIG. 1 shows an exemplary lead core precursor 20 for forming a 9 mm bullet. The precursor has a base or heel 22 from which a sidewall 24 extends forward. An aft portion of the sidewall 24 is substantially cylindrical and a fore portion, commonly referred to as a nose 27 of the bullet, tapers to a flattened rim 26. Inboard of the rim 26 is a nose cavity 28 having a wall 30. In this exemplary embodiment, the precursor 20 has a length L of nominally about 0.640 inch. A nominal maximum diameter D along the substantially cylindrical portion is about 0.346 inch. A nominal nose diameter $D_N$ at an exterior of the flattened rim 26 is about 0.230 inch. The cavity has a depth of length $L_C$ of about 0.270 inch. It should be appreciated that the core precursor 20 may be formed by swaging, casting of molten metal or another appropriate process.

Figure 2:
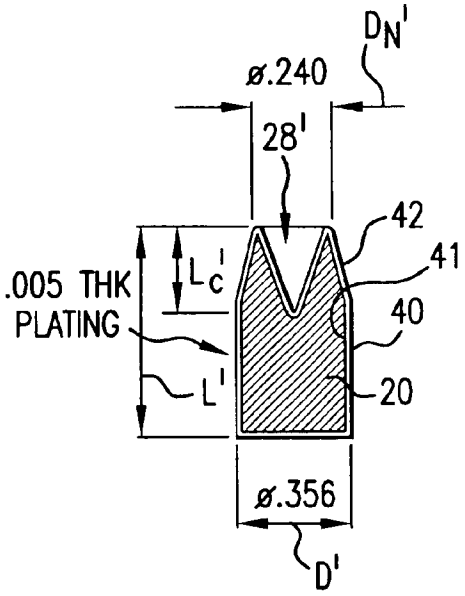
FIG. 2 is a longitudinal sectional view of the precursor of FIG. 1 with a plating.

FIG 2 shows the core precursor 20 having a plating 40. The exemplary plating 40 includes an inner surface 41 and an outer surface 42 and is an about 0.005 inch thick metallic plating of, for example, copper. A nickel plating may also be used. In one embodiment, the nickel plating may be preceded by an initial flash copper plating step. It should be appreciated that the plating 40 or coating is applied by electrolysis (e.g., electroplating), impingement (e.g. mechanical plating), or the like as is known in the art.

Given the nominal thickness of the plating 40, the plated precursor 20 has a nominal maximum diameter D' of about 0.356 inch and nominal nose diameter $D_N'$ of about 0.240 inch. A nominal depth $L_C'$ of cavity 28' is still about the same as $L_C$ while a nominal bullet length L' is increased by twice the plating 40 thickness over the length L. The plating 40 is advantageously thicker than commonly used, preferably at least about 0.004 inch. To avoid compromising the mass of the bullet, the plating thickness is advantageously less than about 0.020 inch, with about 0.005–0.010 inch being preferred.

Figure 3:
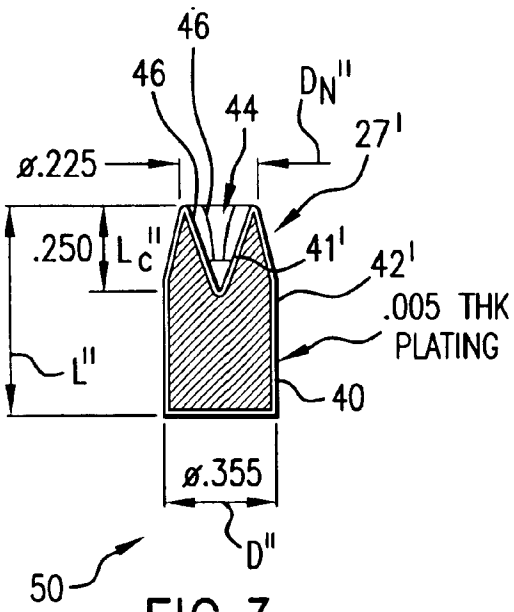
FIG. 3 is a longitudinal sectional view of the plated precursor of FIG. 2 after mechanical deformation.

After plating, the plated core 20 is placed in a die and restruck. The restriking substantially finishes the profile of bullet, shown generally at 50 of FIG. 3, slightly reducing the maximum diameter D' to a diameter D" having a nominal value of about 0.355 inch. The most dramatic deformation due to the restriking is adjacent bullet nose 27'. An internal punch reforms the prior plated cavity 28' into a final cavity 44. The restriking impresses a plurality of grooves 46 (e.g., about four or five to about eight grooves) along the interior of the cavity 44. As is generally known in the art, the grooves 46 support expansion and formation of impact petals in the bullet nose 27' as the bullet 50 encounters soft tissue of a target (e.g., mushrooming).

In accordance with the present invention, the grooves 46 are formed in an outer surface 42' of the plating 40 and do not penetrate an inner surface 41' of the plating 40. To do this, the restriking advantageously does not expand the cavity 44, which might rupture the plating 40 due to tensile forces. The exemplary restriking advantageously compresses nose 27', causing a slight narrowing of the cavity 44 away from the grooves 46. For example, the nose diameter $D_N$' may be reduced to diameter $D_N$" having a nominal value of about 0.225 inch. The exemplary restriking also shortens the depth $L_C$' of cavity 44 to length $L_C$" having a nominal value of about 0.250 inch and shifts the ogive/body intersection aft. In one embodiment, a thickness of the plating 40 in proximity to the grooves 46 is a minimum of about 0.004 inch and, preferably from about 0.0055 to about 0.006 inch in thickness within the cavity 44 after restriking. In one embodiment, the grooves 46 are a width of about 0.025 inch and a depth of about 0.050 inch within the cavity 44.

The bullet 50 may be loaded into a case with propellant and a primer to form a cartridge. The bullet 50 may be used alternatively, such as in a shotshell sabot or a caseless ammunition round. The total encapsulation of the lead core precursor 20 by plating 40 may provide an improved appearance and may reduce user contact with lead during handling.

One or more embodiments of the present invention have been described. Nevertheless, it will be understood that various modifications maybe made without departing from the spirit and scope of the invention. For example, various different ogive and cavity shapes may be used as may be various different groove shapes and orientations. The dimensions given are merely exemplary and actual dimensions will be influenced by the particular caliber, desired bullet mass, and various form and performance considerations. Accordingly, other embodiments are within the scope of the following claims.

What is claimed is:

1. A bullet comprising:

a metal-containing core, having an aft end and a sidewall extending forward therefrom to a nose, said nose having a cavity extending therein;

a metallic plating having an inner surface contacting said core and an opposing outer surface, said metallic plating completely encapsulating the core including an entire surface of the core that defines an interior of said cavity, and including encapsulating the entire interior of said cavity; and a plurality of grooves formed in said outer surface within said interior of said cavity that do not rupture said metallic plating, wherein said plurality of grooves extend at least one half the length of said cavity.

2. The bullet of claim 1 wherein the metallic plating, along at least a majority of the surface of the core, has a thickness of at least 0.004 inch.

3. The bullet of claim 2 wherein said thickness along said majority is 0.0045 inch–0.010 inch.

4. The bullet of claim 2 having a maximum diameter between 0.35 and 0.46 inch.

5. The bullet of claim 4 wherein a ratio of said overall length to said maximum diameter is 1.5–2.5.

6. The bullet of claim 5 wherein said plating completely encapsulating the core is an electroplating.

7. The bullet of claim 5 wherein said plating completely encapsulating the core is a mechanical plating.

8. The bullet of claim 2 wherein said plating completely encapsulating the core is copper-based.

9. The bullet of claim 2 wherein a flash of copper is deposited between a nickel plating and said core.

10. The bullet of claim 2 in combination with:

a case selected from the group consisting of .357 Magnum, .357 Sig, .38 Special, .40 Smith & Wesson, .44 Magnum, .45 Automatic, 9 mm Luger and 10 mm Automatic, the bullet being accommodated by a mouth of the case;

a propellant charge within the case; and a primer held by the case so as to form a cartridge.

* * * * *